United States Patent [19]

Donais et al.

[11] Patent Number: 4,550,964

[45] Date of Patent: Nov. 5, 1985

[54] HINGED COVER AND LABEL ASSEMBLY FOR CONNECTOR BLOCK

[75] Inventors: Norman Donais, Oakville; Ronald Nitowski, Naugatuck, both of Conn.

[73] Assignee: The Siemon Company, Watertown, Conn.

[21] Appl. No.: 633,403

[22] Filed: Jul. 23, 1984

[51] Int. Cl.[4] ..... H01R 13/447

[52] U.S. Cl. ..... 339/44 M; 339/113 B; 339/198 J

[58] Field of Search ..... 339/43, 44 R, 113 B, 339/198 J

[56] References Cited

U.S. PATENT DOCUMENTS 3,508,257 4/1970 Grogan, Jr. ..... 339/198 J 3,716,815 2/1973 Riches ..... 339/44 M 3,836,826 9/1974 Hotchkiss et al. ..... 339/198 J

*Primary Examiner*—Gil Weidenfeld

*Assistant Examiner*—Paula Austin

*Attorney, Agent, or Firm*—Fishman & Dionne

[57] ABSTRACT

A hinged cover assembly for a connector block comprising an insulating lid portion having a pair of flexibly attached pin hinges at one end thereof is presented. The pin hinges are insertable in and form a friction fit with oppositely disposed spaces on each fanning strip of the connecting block. Preferably, the pin hinges consist of a pair of labels interconnected by straps which double back over themselves and a pair of pins to form a strong, flexible strapped pin hinge. The straps and labels may be separate pieces or formed as a one-piece construction.

20 Claims, 8 Drawing Figures

Fig. 1.
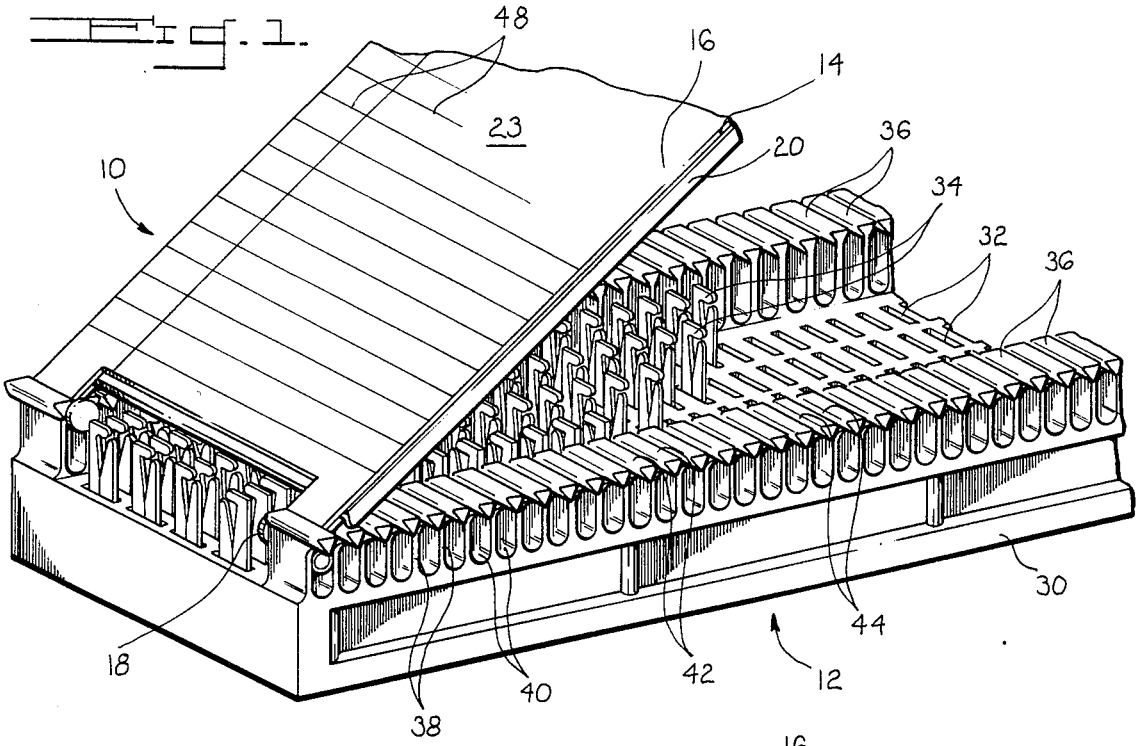
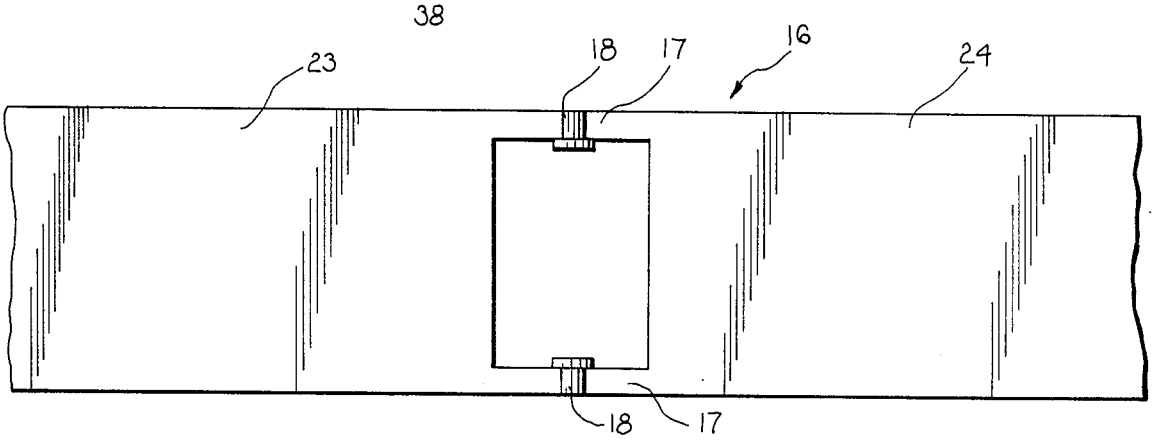
Fig. 2.
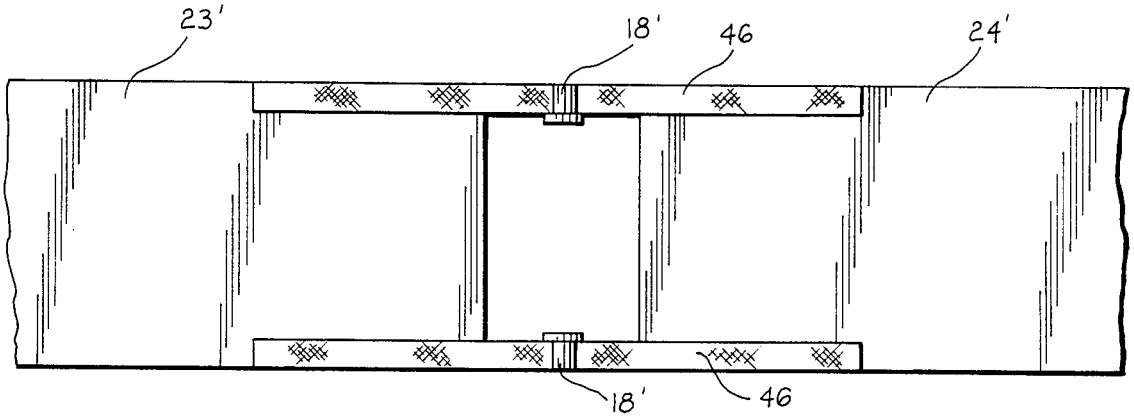
Fig. 2A.

HINGED COVER AND LABEL ASSEMBLY FOR CONNECTOR BLOCK

BACKGROUND OF THE INVENTION

This invention relates to a hinged cover for a connector block of the type used in the telephonic and related industries. More particularly, this invention relates to a new and improved cover hingedly mounted on a connector block such as the well known type 66 quick connect M block. The hinged cover of the present invention provides a base for labeling circuits and provides dead front protection from shorts and any other undesirable contact.

Protective lids or covers used on connector blocks and the like are well known to those in the telephonic and related arts. These prior art covers are generally comprised of a suitable insulating material, i.e., plastic, and effect protection of the exposed connectors and conductors from shorts and other contact. The covers also serve an important function, as a base for providing labels and other identification of circuitry. Typically, these covers are attached to the block by the manufacturer along one of the longitudinal sides thereof. i.e., one of the sides having a fanning strip. Unfortunately, because the cover is positioned along a fanning strip, the telephone installer encounters interference during installation and wiring of the connector block. Thus, the installer or repair person finds it very difficult to access that fanning strip which is in communication with the cover during a normal wiring or similar procedure.

SUMMARY OF THE INVENTION

The above discussed and other problems of the prior art are overcome or alleviated by the hinged cover of the present invention. In accordance with the present invention, a novel hinge and cover assembly for conventional connector blocks in the telephonic and related arts is provided which effects access to substantially all portions of the block during wiring procedures.

The hinged cover of the present invention is comprised of a plastic or other insulating lid portion having a pair of flexibly attached pin hinges at one end thereof. These pin hinges are insertable in oppositely disposed spaces on each fanning strip of the connector block. The pin hinges consist of a pair of labels interconnected by two straps which double back over themselves and a pair of pins to form a strong, flexible strapped pin hinge. The straps and labels may be separate pieces or formed as a one-piece construction. Alternatively, the pin hinges may consist of the two straps which double back over themselves and a pair of pins and which are attached directly to the lid (without labels). Means for snap locking the lid portion onto the connector block (via the fanning strips) may be provided on the lid.

The hinged cover hereinabove described easily swings between a closed and open position. In an open position, total access to virtually every part of the connector block is afforded by the strapped hinge pin and cover assembly. This is a significant improvement over earlier discussed prior art connector block covers. In a closed position, the present invention provides protection from any undesirable contacting or shorting. The adhesive labels which are optionally adhesively applied to both the inside and outside surfaces of the lid offer quick identification of terminal connections whether in a closed or open position.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

FIG. 1 is a perspective view of a portion of a hinged cover attached to a connector block in accordance with the present invention.

FIG. 2 is a plan view of the hinge pins of FIG. 1 connected to the flexible straps of a one-piece label.

FIG. 2A is a plan view of the hinge pins of FIG. 1 connected by flexible straps to a pair of labels in accordance with the present invention.

DESCRIPTION OF THE PREFERRED EMBODIMENT

Figure 3:
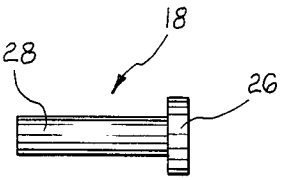
FIG. 3 is a side elevation view of the hinge pin of FIG. 1.

Referring first to FIG. 1, a portion of a hinged cover assembly in accordance with the present invention is shown generally at 10 and is attached to a connector block 12. It should be understood that while the block 12 shown herein is a type 66 quick connect "M" block, the hinged cover 10 may equally be utilized on any other similar connector block.

Referring simultaneously now to FIGS. 1–6, in a first embodiment, the hinged cover assembly 10 essentially consists of a lid portion 14, one piece combination label 16 having a pair of flexible straps 17 and a pair of pins 18. Lid portion 14 is comprised of a suitable electrically insulative material, i.e., plastic, and has a shape corresponding to the upper surface of the particular connector block to be covered. In the embodiment shown in FIG. 1, lid 14 has a substantially rectangular shape corresponding to the shape of connector block 12. Lid portion 14 has depending sidewalls 20 along the longitudinal sides thereof. A suitable snap locking means in the form of raised projections 22 are located at selective intervals along the inside surface of depending sidewalls 20.

Figure 4:
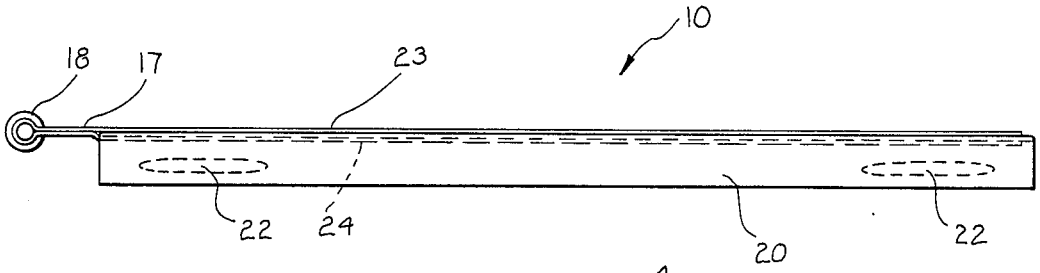
FIG. 4 is a side elevation view of the hinged cover of FIG. 1 in accordance with the present invention.

Referring to FIG. 2, adhesively or otherwise attached to lid 14 is a planar label 16 having flexible strap portions 17. Label 16 may be comprised of any suitable material such as plastic or glass tape so long as the material is strong (i.e resistant to fatigue) and flexible. Planar surfaces 23 and 24 and the straps 17 joining them are adhesively coated. In attaching label 16 to lid 14, pins 18 are centrally positioned along strap portions 17 as shown in FIG. 2. Thereafter, the label 16 is folded about the top and bottom planar surfaces of lid 14 as shown in FIGS. 4 and 5. As a result, strap portions 17 double back upon themselves and pins 18. Consequently, a flexible, yet strong strap is formed which is tightly secured to pins 18 and adhesively attached to lid 14. Note that pin 18 is comprised of a flat head section 26 and an insertable leg 28 (FIG. 3). It should be understood that strap portions 17 adhesively attach to legs 28 of pins 18 and not to head sections 26.

Referring again to FIG. 1, connector block 12 is comprised of an insulating plastic body portion 30 having a plurality of apertures 32 therein. Each aperture holds a quick connect terminal 34 for connecting wire conductors and the like. Fanning strips 36 are provided along the longitudinal edge of each body portion 30. The fanning strips 36 consist of a series of arms 38 defining spaces 40 therebetween wherein wire leads access the interior of block 12 for connection with the terminals 34. Each arm 38 of fanning strips 36 has a flat overhanging lip 42 defining an upper surface thereof. The lips 42 are separated or spaced apart by slots 44.

In accordance with the present invention, the leg sections 28 of strapped hinge pins 18 are slidably inserted through two oppositely disposed spaces 40 in each fanning strip 36. The strapped pins 18 are loaded into space 40 from the inner sides until the head 26 of the pin engages a pair of arms 38 of the fanning strips 36. Alternatively, the pins 18 and straps would be pushed into position from the top through slots 44. Note that in any event, strap portions 17 slidably fit and are retained between two opposing slots 44. Preferably, the pins 18 are mounted in the first spaces 40 of each fanning strip 36 at one end of block 12. The pin 18/strap 17 attachment into spaces 40 and slots 44 of fanning strips 36 provide a reliable, free swinging hinge for lid 14 of cover assembly 10. The pins 18 and strap 17 are sized so that they are held in spaces 40. The above described block 12 is well known in the art and is typical of the structural configuration of such blocks. Accordingly, the strapped hinge pin connection of the present invention will equally apply to any other conventional connector block.

As mentioned, depending sides 20 of lid portion 14 have a plurality of locking means in the form of projections 22. Thus, when the cover assembly 10 is pivotally lowered onto the connector block 12, the depending sidewalls 20 of lid 14 enclose flat lips 42 of fanning strips 36. At this point, the projections 22 contact the lips 42 whereupon the resilient sidewalls 20 are urged outwardly and the projections 22 form a snap lock fit with the overhanging lips 42. Note that the distance between the inside surface of the lid 14 and the projection 22 should be equal to the thickness of each overhanging lip 42 so that cover assembly 10 is firmly supported along the top of the fanning strips 36. Clearly, any other suitable locking means would also be included by the novel cover assembly of the present invention. For example, in FIG. 6, the locking means consists of a pair of extensions 50 each comprising a ball on a shaft and depending downwardly from the inside planar surface of lid portion 14. When the lid 14 is closed, extensions 50 snap into the slots 44 between the fanning strips and are locked and retained therein.

Referring now to FIG. 2A, in an alternative embodiment, the one piece label/hinge strap of FIG. 2 is replaced by separate pieces of tape 46 adhevisely attached to the lid portion 14 or to the lid portion 14 and a pair of labels 23' and 24'. As in the first embodiment, pins 18' are mounted at about the center of each strap 46 whereupon the strap doubles back upon itself to form a strong and flexible pin hinge. The tape surfaces which double back on each other (the surfaces seen in FIG. 2A), are adhesively coated, so they bond to each other and grip the outer surfaces of the pins 18. Also, as in the first embodiment, the labels 23' and 24' are adhesively applied to the inner and outer surfaces of each lid 14.

It will be appreciated that the label/hinge strap of the present invention may be directly attached to a lid without the aid of labels. Thus, in FIG. 5B, the hinge strap consists of separate pieces of tape 46' directly attached to the lid portion 14''. As in the other embodiments, pins 18'' are mounted at about the center of each strap 46' whereupon the strap doubles back upon itself to form a strong and flexible pin hinge. Labels (not shown) may be subsequently applied to the lid portion 14 if desired. The embodiments of FIGS. 2A or 5B may be the preferred embodiments.

Figure 5A:
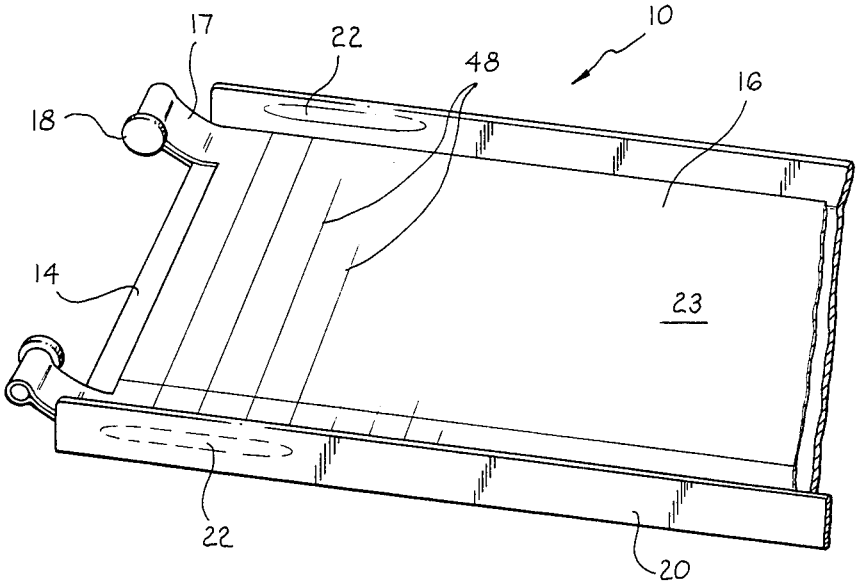
FIG. 5A is a perspective bottom view of a portion of the hinged cover of FIG. 1.
Figure 5B:
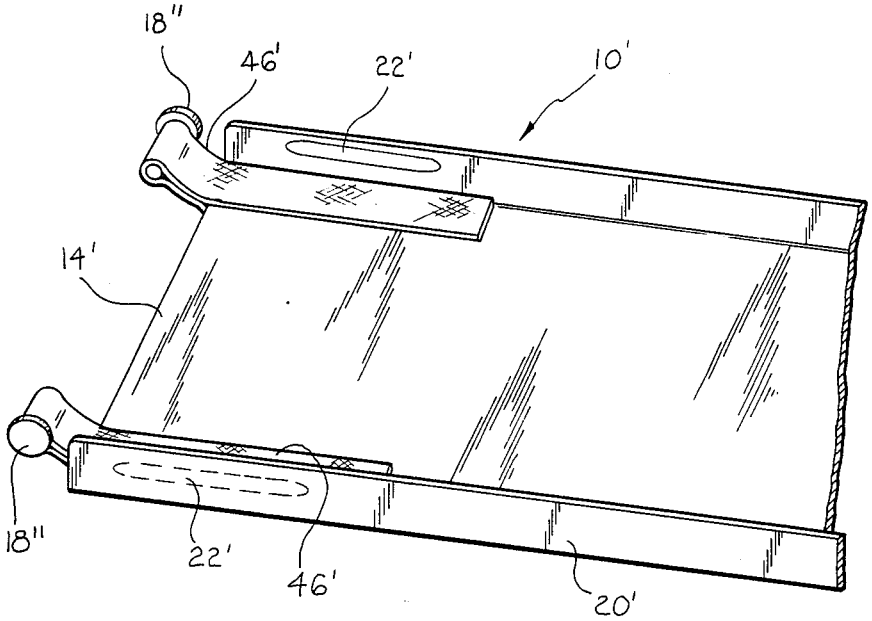
FIG. 5B is a perspective bottom view of another embodiment of a portion of a hinged cover without labels in accordance with the present invention.
Figure 6:
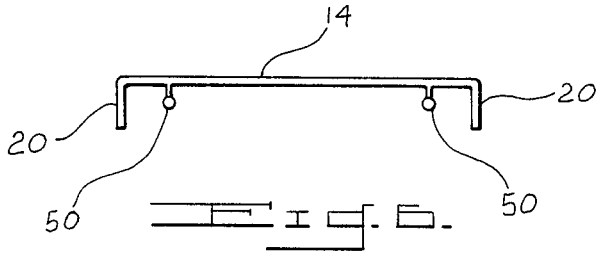
FIG. 6 is an end view of the lid portion of a hinged cover in accordance with the present invention.

It will be appreciated that if the head of the pin is on the inside of the block as shown in FIGS. 1, 2, 4 and 5A, the pin head may interfere with installation tools commonly used with such blocks and therefore act as an undesirable obstruction. Accordingly, in a preferred embodiment, pins 18' are oriented such that the head thereof is positioned on the outside of the block as shown in FIG. 5B. This preferred pin head orientation will thus preclude any impediments to a suitable installation tool.

The labels 16, 23' and 24' of cover assembly 10 are preferably provided with suitable indicia thereon such as lines 48 and possibly numbers so that terminals and connections may be identified by the installer. Accordingly, the installer may easily identify a connection by writing an appropriate comment directly onto a space marked on the label.

The hinged cover assembly 10 of the present invention provides many features and improvements over the earlier discussed prior art covers. In an open position, the present invention affords total access to almost every portion of the connector block 12 and particularly, the spaces 40 in the fanning strips 36. This desirable feature is in distinct contrast to the prior art wherein one fanning strip is obstructed by the cover mounted thereon.

In a closed position, the present invention provided needed protection from electrical shorting and other unwanted mechanical contacting.

Another feature of the present invention is the utilization of labels on both the inside and outside surfaces of the lid 14 for easy identification of terminal connections whether in a closed or open position. Moreover, in the first embodiment of the present invention, the novel integral one-piece construction including a pair of labels and straps, provides inexpensive manufacturing and low labor costs.

Another important feature and advantage is that the hinged cover of this invention remains attached to the block when in the open position. This avoid misplacement of the cover and loss of the data (e.g. connection numbering or schematics) on the label.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A connector block cover assembly, the connector block having a body portion with two fanning strips disposed along the longitudinal sides thereof, the fanning strips comprising a plurality of arms defining spaces therebetween, the arms each having an overhanging flat lip thereon, the lips spaced apart by slots, the cover assembly including:

lid means, said lid means having flat planar inner and outer surfaces to cover a least a portion of said connector block; and strapped hinge means attached to said lid means, said hinge means positioned between oppositely disposed spaces in each of said fanning strips wherein said cover freely pivots about said hinge means between open and closed positions.

2. The cover of claim 1 wherein said lid means includes:

depending sidewalls oppositely disposed along the longitudinal sides of said lid means.

3. The cover of claim 1 wherein said lid means includes:

means for locking said lid means to said connector block.

4. The cover of claim 3 wherein said lid means includes:

depending sidewalls oppositely disposed along the longitudinal sides of said lid means.

5. The cover of claim 4 wherein said locking means is located on said depending sidewalls and includes:

a plurality of projections, said projections forming a snap fit with said overhanging lips of said fanning strips.

6. The cover of claim 3 wherein said locking means includes:

at least one extension depending from said inner surface of said lid means, said extension forming a snap fit between said slots of said overhanging lips.

7. The cover of claim 6 wherein said extension comprises:

at spherical ball attached to a shaft, said shaft being connected to said inner surface of said lid means.

8. The cover of claim 1 wherein said strapped hinge means includes:

a pair of pins, said pins each having a flat head section and a leg section, said leg section being insertable into said oppositely disposed spaces in said fanning strips.

9. The cover of claim 8 wherein:

said head section of each of said pins are positioned on the outside of said connector block.

10. The cover of claim 8 wherein:

said head sections of each of said pins are positioned on the inside of said connector block.

11. The cover of claim 8 wherein said strapped hinge means further includes:

a pair of planar adhesive label means; and a pair of adhesive strap means interconnecting said label means, said strap means having said pair of pins mounted at about the respective centers thereof wherein said strap means are doubled back and wrapped about said pins and wherein said pair of labels are respectively and adhesively attached to said inner and outer surfaces of said lid means.

12. The cover of claim 11 wherein:

said strap means are insertable into said slots between said lips of said fanning strips.

13. The cover of claim 11 wherein:

said label means and said strap means are one-piece.

14. The cover of claim 11 wherein:

said label means and said strap means comprise glass tape.

15. The cover of claim 11 including:

indicia on said labels for identifying connections in said connector blocks.

16. The cover of claim 8 wherein said strapped hinge means comprises:

a pair of adhesive strap means, said strap means having said pair of pins mounted at about the respective centers thereof wherein said strap means are doubled back and wrapped about said pin and wherein said strap means are adhesively attached to said inner and outer surfaces of said lid means.

17. The cover of claim 16 including:

at least one planar adhesive label means attached to said inner or outer surface of said lid means.

18. The cover of claim 16 wherein:

said strap means are insertable into said slots between said lips of said fanning strips.

19. The cover of claim 16 wherein:

said label means and said strap means comprise glass tape.

20. The cover of claim 16 including:

indicia on said labels for identifying connections in said connector blocks.

* * * * *